US011674770B2

(12) United States Patent
Bennink

(10) Patent No.: US 11,674,770 B2
(45) **Date of Patent: *Jun. 13, 2023**

(54) MULTI-CALIBER WEAPON SYSTEM AND COMPONENTS

(71) Applicant: Andrew Bennink, De Soto, KS (US)

(72) Inventor: Andrew Bennink, De Soto, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/463,437

(22) Filed: Aug. 31, 2021

(65) Prior Publication Data

US 2022/0146226 A1 May 12, 2022

Related U.S. Application Data

(63) Continuation of application No. 16/797,349, filed on Feb. 21, 2020, now Pat. No. 11,137,226.

(Continued)

(51) Int. Cl.

| | |
|---|---|
| ***F41A 11/00*** | (2006.01) |
| ***F41A 3/66*** | (2006.01) |
| ***F41A 21/48*** | (2006.01) |
| ***F41A 21/10*** | (2006.01) |
| ***F41A 9/32*** | (2006.01) |

(52) U.S. Cl.

CPC ..... *F41A 21/10* (2013.01); *F41A 3/66* (2013.01); *F41A 9/32* (2013.01); *F41A 11/00* (2013.01); *F41A 21/485* (2013.01)

(58) Field of Classification Search

CPC .. F41A 11/00; F41A 11/02; F41A 3/66; F41A 21/00; F41A 21/10; F41A 21/12; F41A 21/24; F41A 21/48; F41A 21/481; F41A 21/482; F41A 21/484;

(Continued)

(56) References Cited

U.S. PATENT DOCUMENTS 2,149,707 A * 3/1939 Murbach ..... F41A 21/484 89/14.3
2,736,118 A * 2/1956 Clarkson ..... F41A 21/12 42/76.02

(Continued)

FOREIGN PATENT DOCUMENTS

DE 1936413 A1 * 2/1971
GB 2083598 A * 3/1982 ..... F41A 19/39
WO WO-2013058858 A2 * 4/2013 ..... F41A 19/08

*Primary Examiner* — Gabriel J. Klein

(74) *Attorney, Agent, or Firm* — Jason P. Webb; Pearson Butler

(57) ABSTRACT

There is a multi-caliber weapon system. The multi-caliber weapon system comprises: a frame body, with a front body portion, a middle body portion, and a rear body portion, and including: a plurality of frame flanges, each frame flange being coupled to an interior of the frame body and extending upwardly therefrom; a barrel, removably coupled to the front body portion of the frame body, including: a plurality of barrel rings, each barrel ring being disposed around a circumference of the barrel and spaced along a length of the barrel, wherein the barrel rings are disposed on the frame flanges; a chamber, removably coupled to the middle body portion of the frame body, and removably coupled to the barrel; and a bolt, removably coupled to rear body portion of the frame body, removably coupled to the chamber, and including: a bolt face, removably coupled to a front bolt portion.

20 Claims, 14 Drawing Sheets

Related U.S. Application Data

(60) Provisional application No. 62/808,483, filed on Feb. 21, 2019.

(58) Field of Classification Search
CPC ..... F41A 21/485; F41A 21/487; F41C 7/00; F41C 7/11; F41C 23/00
See application file for complete search history.

(56) References Cited

U.S. PATENT DOCUMENTS 3,845,581 A * 11/1974 Infantino ..... F41A 3/74 42/76.01
4,920,678 A 5/1990 Brown
5,046,275 A 9/1991 Brown
5,410,834 A * 5/1995 Benton ..... F41A 21/482 42/75.02
6,293,040 B1 9/2001 Luth
7,131,228 B2 11/2006 Hochstrate et al.
7,631,453 B2 12/2009 Longueira
7,685,757 B2 3/2010 ROhrauer
7,726,060 B1 6/2010 Jones
7,810,271 B2 10/2010 Patel
8,079,169 B2 12/2011 Gregg
8,307,575 B1 11/2012 Battaglia
8,397,415 B2 3/2013 Laney et al.
8,397,416 B2 3/2013 Laney et al.
8,429,844 B2 * 4/2013 Dextraze ..... F41A 9/71 42/73
9,459,060 B2 10/2016 Langevin et al.
9,823,031 B2 11/2017 Robbins et al.
2006/0037464 A1 * 2/2006 Moore ..... F41A 3/12 89/125
2013/0139424 A1 * 6/2013 Devine ..... F41A 3/66 42/71.01
2014/0360076 A1 * 12/2014 Zamlinsky ..... F41C 23/22 42/75.03
2016/0047611 A1 * 2/2016 Battaglia ..... F41A 3/14 42/16
2016/0209155 A1 * 7/2016 Dodson ..... F41A 21/02
2018/0202736 A1 * 7/2018 Teetzel ..... F41A 11/02
2019/0226789 A1 * 7/2019 Battaglia ..... F41A 21/484

* cited by examiner

MULTI-CALIBER WEAPON SYSTEM AND COMPONENTS

CROSS-REFERENCE TO RELATED APPLICATIONS

This invention claims priority under 35 U.S.C. § 120, to the U.S. Non-Provisional patent application Ser. No. 16/797,349, to Andrew Bennink, filed on Feb. 21, 2020, and therethrough, to Provisional Patent Application No. 62/808,483, to Andrew Bennink, filed on Feb. 21, 2019, both of which are incorporated by reference herein in their entireties.

FIELD OF THE INVENTION

The present invention relates to firearms, specifically to multi-caliber weapon systems.

DESCRIPTION OF THE RELATED ART

In the related art, it has been known to use ammunition for firearms offered in numerous bullet calibers, with casings of various dimensions. Various rounds can be grouped together into families based on similar case lengths and diameters. Each round is shaped and sized for a particular firearm, rifle or group of rifles and will perform best in similar rifles to what it was designed for.

Shooters generally select a firearm on the basis of a round size and price. Rounds are similar to screwdrivers, in that not every sized screwdriver is applicable to every situation. For example, the round used to humanely take an elephant would be inappropriate for hunting rabbits and vice versa. Further, in combat operations, weapon systems are optimized for different situations and therefore combatants may have need of a great variety of weapon systems during different missions/deployments.

When a round is chambered in a rifle (e.g. right before it is fired), there are two parts of the firearm that are in contact with the round: the chamber and the bolt face. The bolt face is the structure that pushes the round for yard into the chamber and serves as the backing that holds the round there while it is fired. It has a recess that fits, like a glove, the backside of the round. The chamber is a block of material that is shaped to fit the rest of the round like a glove to hold the round in place with the bullet of the round pointed into the barrel of the firearm. Because the fit of these parts is so close and tight, one is generally not able to use different shape/sizes of ammunition in the same firearm. As an example, one can typically use 38 Special cartridges with a .357 Magnum firearm. In another example, one can generally use the same bolt face for both a 300 Blackout headstamp and a 5.56 mm NATO headstamp. However, such mix-and-match usage is generally rare and problematic. Therefore, it has been desirable to have multiple rifles in different calibers for use during different bunting seasons or other purposes.

However, the cost of firearms limits the number of shooters to a few who possess a range of firearms capable of firing every round available. As a result, many shooters would like to have a single rifle capable of accepting a multitude of different round sizes that could be used in a variety of situations. As an example, some hunters go on elaborate expeditions to take a specific animal that requires a round in a certain caliber range and take that animal early in the trip. The hunter then may wish to enjoy the rest of the trip hunting a different animal that requires a different caliber than the first. As a result, the typical hunter would have to pack multiple rifles and would be limited to an animal that has a size that corresponds to the guns that were packed and that were in season. As a result, there is a need for one rifle that is configurable to accept a variety of caliber/gauges sizes.

Some improvements have been made in the field. Examples of references related to the present invention are described below in their own words, and the supporting teachings of each reference are incorporated by reference herein:

U.S. Pat. No. 4,920,678, issued to Brown, discloses an improvement for a caliber conversion kit for semi automatic and automatic firearms to allow the use of smaller caliber ammunition within. The conversion kit comprises the replacement of the bolt, barrel and magazine clip of the existing firearm so that the firing speed and thus the action or feel is similar to a standard non modified firearm having larger caliber ammunition.

U.S. Pat. No. 6,293,040, issued to Luth, discloses are interchangeable upper receiver assembly for use with a hand held weapon and the interchangeable upper receiver assembly in combination with the hand held weapon, where the interchangeable upper receiver assembly includes an integral, unitary breech block and barrel that is operably removably couplable to the lower receiver assembly of the hand held weapon in an engaged disposition. A bolt assembly is slidably disposed within a bolt recess defined in the receiver breech block and barrel. The bolt includes a firing pin slidably disposed therein, the firing pin being, selectively actuatable by the trigger assembly when the receiver is in the engaged disposition. A chamber for receiving a ammunition cartridge therein is defined in the receiver and is disposed with respect to the firing pin such that actuation of the firing pin from a cocked position to a firing position ammunition cartridge to discharge the cartridge, the interchangeable upper receiver assembly being interchangeable with a primary upper receiver assembly of the hand held weapon.

U.S. Pat. No. 7,685,757, issued to Rohrauer, discloses a rifle comprising a housing, a barrel anchored thereon and a forearm extending below the barrel. The barrel is anchored by a fastening element which extends through a cross hole of the housing. The forearm has at least one axial projection that detachably engages into a seat of the housing. The cross hole for anchoring the barrel and the seat for fastening the forearm intersect and the forearm comprises a Snap-in recess for the fastening element to Snap in when the barrel is anchored.

U.S. Pat. No. 8,307,575, issued to Battaglia, discloses a rifle assembly includes a central chassis having a vertically aligned opening and a pair of slots extending from the side walls into the opening. An action has a pair of projections engageable with the slots in the chassis and is removably securable within the chassis. The action is insertable into and removable from above the chassis, with the action axis at an angle to the chassis axis, to engage the respective action and chassis slot and projection. The action is rotatable with respect to the chassis upon engagement of the respective action and chassis slot and projection to align the axes of the action and chassis and lock the action to the chassis against rotation and removal. A resilient material is disposed between the chassis and action to load the action to the chassis with a force in excess of recoil force of the action.

U.S. Pat. No. 8,397,416, issued to Laney et al., discloses a multi-caliber firearm has a breech sleeve connecting a barrel to a receiver and a stock. The stock includes a forward V-block and a rearward V-block. Each of the V-blocks defines a V-cut along a top portion and a through hole substantially aligned with the cross-sectional center of the V-block. The forward V-block extends through a cutout portion of the receiver and into the breech sleeve. The breech sleeve is fastened to the stock through the through hole in the forward V-block to provide a rigid connection between the stock and the breech sleeve. The receiver is fastened to the stock through the through hole in the rearward V-block to provide a rigid connection between the receiver and the stock.

The inventions heretofore known suffer from a number of disadvantages. Some disadvantages that other inventions suffer from include, but are not limited to: not being able to adapt the weapon to a type that is allowed or otherwise more appropriate to the situation; not allowing for change between a rifle and a shotgun, not just in the same class or family of firearms; not allowing for a quick change; being less accurate; having less reliable action or firing; locking less tight or being less secure; not allowing for swapping out barrels of different size; not being able to be used for training with a single firearm; not being able to replace multiple firearms; not being able to be used with varying lengths of cartridges or shells as long as the chamber overall length (OAL) is equal to or greater than the length of the cartridge or shell; not being easier to change a caliber or gauge; not being easier to use; requiring the operator to learn multiple weapon platforms instead of only having to learn how to use one weapon; and not allowing for a single weapon to take multiple calibers and gauges.

What is needed is a multi-caliber weapon system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available multi-caliber weapon systems. Accordingly, the present invention has been developed to provide an multi-caliber weapon system and components.

In one embodiment of the invention, there may be a multi-caliber weapon system, that may comprise a frame body, with a front body portion, a middle body portion, and/or a rear body portion, and/or that may include a plurality of frame flanges. Each frame flange may be coupled to an interior of the frame body and/or extending upwardly therefrom. The multi-caliber weapon system may also comprise a barrel, that may be removably coupled to the born body portion of the frame body, and may include a plurality of barrel rings. Each barrel ring may be disposed around a circumference of the barrel and/or spaced along a length of the barrel. The barrel rings may be disposed on the frame flanges. The multi-caliber weapon system may further comprise a chamber, that may be removably coupled to the middle body portion of the frame body, and/or removably coupled to the barrel; and/or a bolt, that may be removably coupled to rear body portion of the frame body, removably coupled to the chamber, and or including a bolt face, that may be removably coupled to a front bolt portion.

In another embodiment of the invention, the frame body may further comprise a chamber holder that may be disposed along a middle body portion. The chamber may be disposed within the chamber holder. The chamber may be removably and/or slidably coupled to the chamber holder.

In a further embodiment of the invention, the multi-caliber weapon system may further comprise a frame body cover that may be removably coupled to the frame body and/or disposed over a portion of the barrel, the chamber, and/or the bolt. The bolt face may include an array of bolt face tabs that may be disposed about an outside of the bolt face. The chamber may further comprise a chamber groove disposed along an outside of the chamber.

In yet another embodiment of the invention, the multi-caliber weapon system may further comprise a front frame cover that may be removably coupled to the front body portion of the frame body; and/or a rear frame cover that may be disposed adjacent to the front frame cover and/or removably coupled to the rear body portion of the frame body. The barrel may include a conical chamber coupling that may be disposed at an end opposite the from body portion and/or near the middle body portion. The multi-caliber weapon system may further comprise a plurality of barrels, wherein each barrel may be selectably and/or removably coupleable to the chamber.

Still, in another embodiment of the invention, the chamber may include socket protrusions, and/or the barrel may include barrel voids that may be removably coupled to the socket protrusions. The chamber may include a plurality of teeth. The plurality of teeth may be disposed along an outside of the chamber and/or may extend outwardly therefrom. The plurality of teeth may be removably and/or slidably coupled to the chamber holder.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitably manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
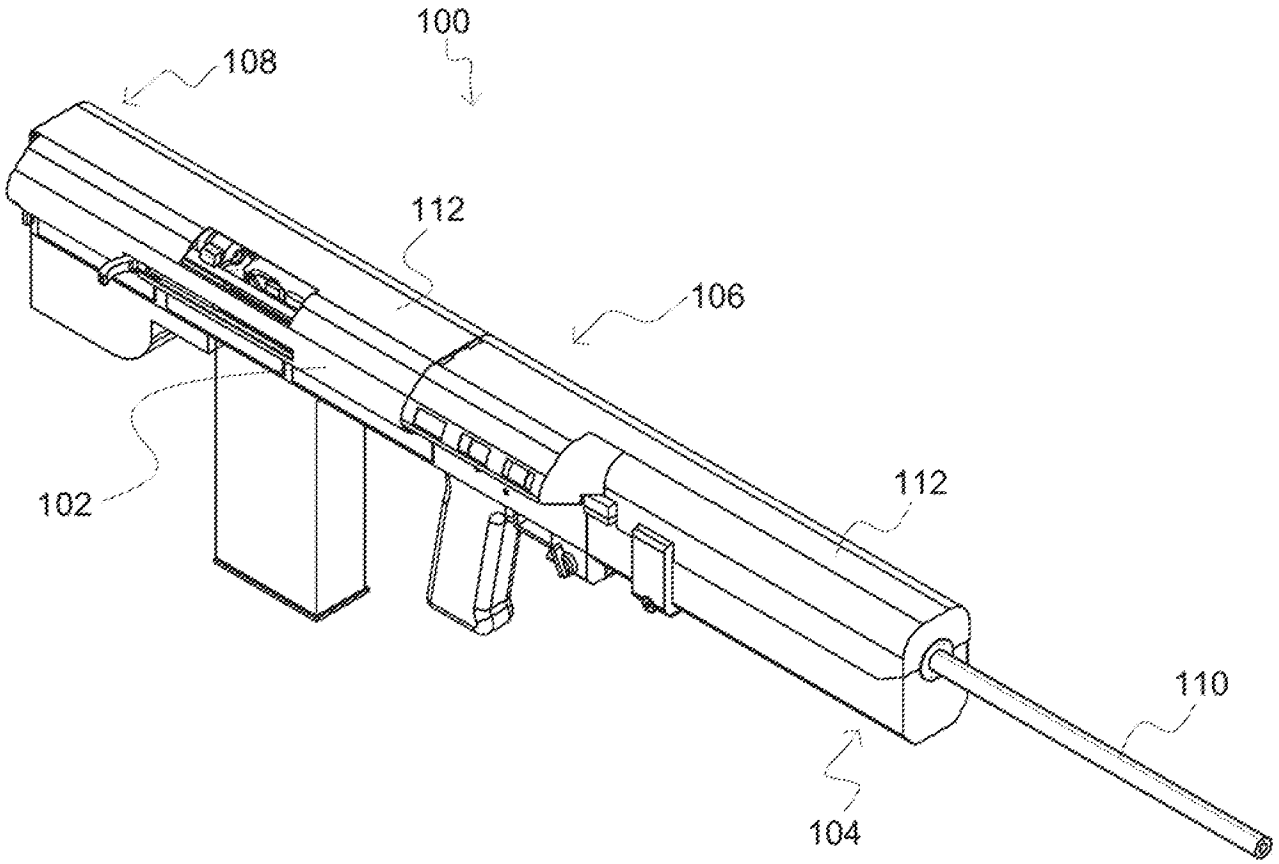
FIG. 1 is a front perspective view of a multi-caliber weapon system, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 illustrates a front perspective view of a multi-caliber weapon system, according to one embodiment of the invention. There is shown a multi-caliber weapon system 100. The multi-caliber weapon system 100 includes a frame body 102. The frame body 102 has a front body portion 104, a middle body portion 106, and a rear body portion 108. A barrel 110 is disposed along the front body portion 108 and extends outwardly therefrom. A frame body cover 112 is disposed over a portion of the barrel 110 and coupled to the frame body 102.

The illustrated frame body 102 is substantially elongated and includes a front body portion 104, a middle body portion 106, and a rear body portion 108. The frame body 102 and body portions 104, 106 and 108 support components of the weapon system 100. The frame body 102 is shaped to be large enough to hold a barrel of the largest size (e.g. largest shotgun barrel intended for the weapon system). Accordingly, the frame body 102 may be comprised of a variety of materials for providing support, such as, but not limited to: metals, plastics, and rubber.

The frame body cover 112 is also substantially elongated and is coupled to the frame body 102. The frame body cover 112 covers the frame body 102 and a portion of the barrel 110. The frame body cover 112 may be removably coupled to the frame body 102 so that the frame body cover 112 may be removed from the frame body 102 and so that the barrel 110 may be accessed. In one non-limiting embodiment, the frame body cover 112 may be a plurality of frame covers 112 removably coupled to the frame body 102 so that one can easily get to components of the multi-caliber weapon system 100 to remove or replace them. The frame body cover 112 may serve to cover the frame body 102 to protect the multi-caliber weapon system 100 and/or to keep debris out of an inside of the multi-caliber weapon system 100. The frame body cover 112 may be removably coupled to the frame body 102 by coupling, methods such as, but not limited to: pinning, snap-fitting, tension-fitting, friction, tongue and groove, locking lugs, and bolting. As a result, the frame body cover 112 may be comprised of a variety of materials such as, but not limited to: metals, plastics, and rubber.

Figure 2:
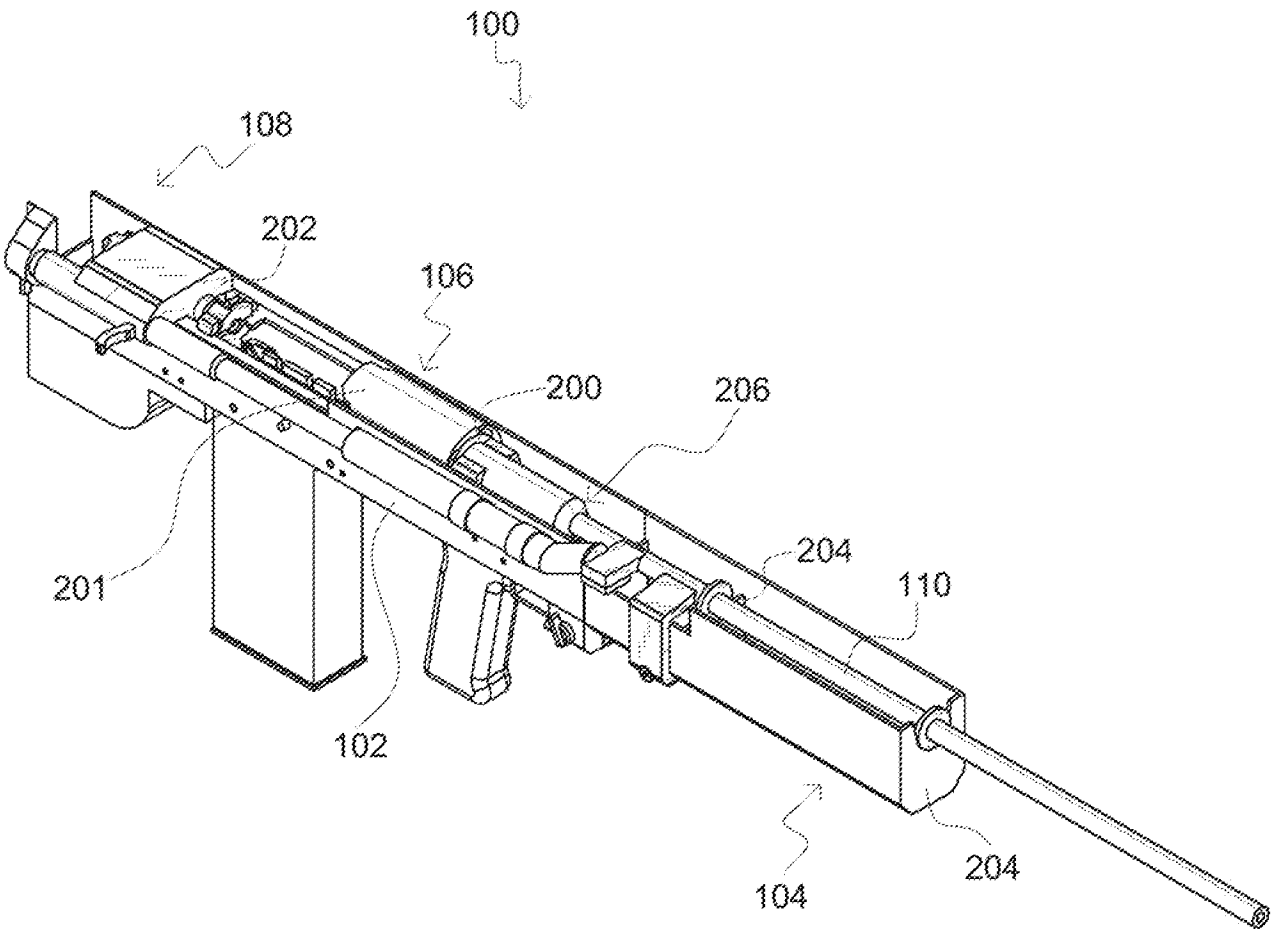
FIG. 2 is a front perspective view of a multi-caliber weapon system with a removed frame body cover, according to one embodiment of the invention.

FIG. 2 illustrates a front perspective view of a multi-caliber weapon system with a removed frame body cover, according to one embodiment of the invention. As shown, the multi-caliber weapon system 100 includes a frame body 102 with a front body portion 104, a middle body portion 106, and a rear body portion 108. Disposed along a front body portion 104 of the frame body 102 is a barrel 110. A chamber 200 is disposed along a middle body portion 106 of the frame body 102 and is coupled to the barrel 110. The chamber 200 is disposed within a chamber holder 201. The chamber holder 201 is coupled to the frame body 102 at a middle body portion 106. A bolt is disposed along a rear body portion 108 of the frame body 102 and is coupled to the chamber and/or chamber holder 200. The frame body 102 also includes a plurality of frame flanges 204 coupled to an interior of frame body 206 and extending upwardly therefrom. The barrel 110 is disposed on the plurality of frame flanges 204.

The illustrated barrel 110 is coupled to a front body portion 104 of the frame body 102. The barrel 110 is substantially elongated and tubular. The barrel 110 is hollow. In one non-limiting embodiment, the barrel 110 may include a tube through which a controlled explosion or rapid expansion of gases are released in order to propel a projectile, or round, out of the end at a high velocity. The barrel 110 may be comprised of a variety of materials such as, but not limited to, metals.

The barrel 110 is disposed on the plurality of frame flanges 204 The plurality of frame flanges 204 are coupled to an interior of frame body 206 and extend upwardly therefrom. The frame flanges 204 are substantially concave. The frame flanges 204 are substantially U-shaped.

In one non-limiting embodiment, the barrel 110 may be removably coupled to the front body portion 104 of the frame body 102. The barrel 110 may be removably coupled to the frame body 102 through a variety of couplings, such as, but not limited to threading and locking lugs. The barrel 110 may include a quick-change threaded lug that connects the barrel 110 to the frame body 102. The barrel 110 may include a quick-change handle that is coupled to the barrel 110 and follows a profile of a front body portion 104. In another non-limiting embodiment, the barrel 110 may be bolted to the frame body 102. Accordingly, in operation, the barrel 110 may be removed and changed out by unscrewing it and thereby unlocking it from the front body portion 104 and from the frame body 102.

The barrel 110 is removably coupled to the chamber 200 and is disposed along the middle body portion 106 of the frame body 102. The chamber 200 may be removably coupled to the barrel 110 through a variety of couplings, such as, but not limited to: socket couplings, pinning, bolting, threading, locking lugs, tension, and friction. The chamber 200 is substantially cylindrical and substantially hollow. The chamber 200 may have any size and/or shape for chambering, or holding, a cartridge. The chamber 200 may be comprised of a variety of materials such as, but not limited to, metals.

In one embodiment, the chamber 200 may be removably coupled to the middle body portion 106 of the frame body 102. The chamber 200 may include locking lugs for removably coupling to the middle body portion. However, the chamber 200 may removably couple to the middle body portion 106 through a variety of couplings, such as screws, locking pins, and so on.

The chamber 200 is disposed within a chamber holder 201. The chamber 200 may be slidably and removably coupled to the chamber holder 201. The chamber holder 201 is coupled to the frame body 102 at a middle body portion 106. The chamber holder 201 is substantially cylindrical. The chamber holder 201 may be size and/or shaped to contain the chamber 200. The chamber holder 201 may be fixedly connected to the frame body 102, or may be intrinsic to the frame body 102. In one embodiment, the chamber holder 201 is an extension of the frame body 102. The chamber holder 201 may be comprised of a variety of materials such as, but not limited to: metals, plastics, and rubber.

The chamber 200 is also removably and functionally coupled to the bolt 202 at an end opposite the barrel 110. The bolt 202 may be slidably coupled to the chamber 200 and/or chamber holder 201. For instance, in one embodiment of the invention, the bolt 202 may slide along an interior of the frame body 106 and make contact with the chamber 200. The bolt 202 is disposed along a rear body portion 108 of the frame body 102. The bolt 202 may be comprised of a variety of materials such as, but not limited to, metals.

In operation of one non-limiting embodiment of the invention, there is a multi-caliber weapon system 100 that a builder can customize to any cartridge based on the head stamp that they decide to use. By removing and/or replacing the barrel 110, the chamber 200, and the bolt face with a selected size, one can use the exact same weapon system 100 with the same trigger feel, etc., but then insert a completely different cartridge into the chamber 200. First, one unscrews a barrel locking lug to remove the barrel 110 from the frame 102. Then, one rotates the barrel 110 ninety degrees and removes the barrel 110 and the chamber 200 together in a counterclockwise direction. Next, one slides the new barrel 110 and chamber 200 into the frame body 102 and locks them into place by rotating the barrel 110 and chamber 200 together in a clockwise direction.

Figure 3:
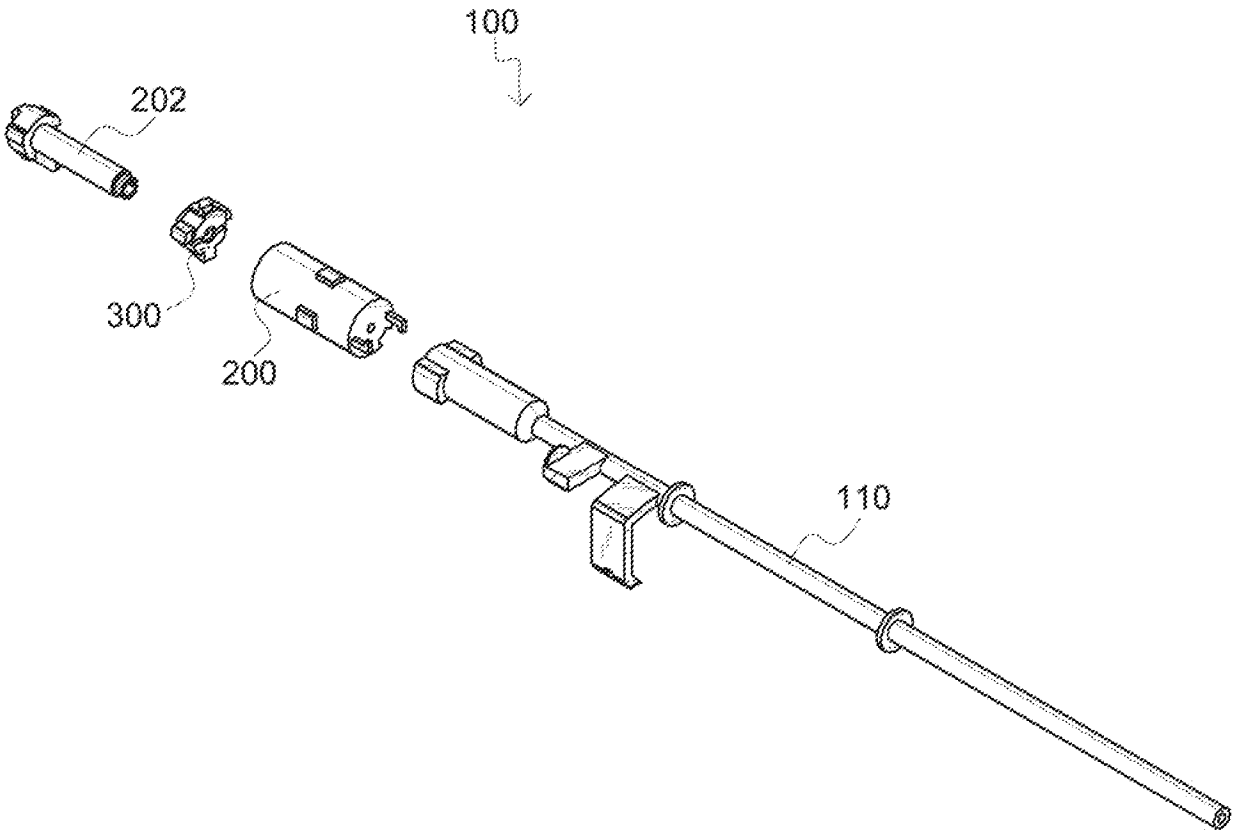
FIG. 3 is a front perspective exploded view of a removable barrel, chamber, and bolt of a multi-caliber weapon system according to one embodiment of the invention.

FIG. 3 illustrates a front perspective exploded view of a removable barrel, chamber, and bolt of a multi-caliber weapon system according to one embodiment of the invention. There is shown a barrel 110, a chamber 200, a bolt 202, and a bolt face 300. The chamber 200 is removably coupled to the barrel 110. The bolt 202 is slidably and functionally coupled to the chamber 200. The bolt face 300 is removably coupled to the bolt 202, and removably and functionally coupled to the chamber and/or chamber holder 200.

The illustrated bolt 202 includes a bolt face 300 removably coupled to the bolt 202. In one non-limiting embodiment, there is a multi-caliber weapon system 100 that allows an operator to replace three key parts: the bolt face 300, the chamber 200 and the barrel 110. Being able to replace these three parts allows one to use any kind of centerfire and/or rimfire ammunition shape/size that one wants, as long as the replaced parts match the ammunition that one plans to use. The barrel 110 includes a quick-change threaded lug that connects the barrel 110 to the frame (See e.g., FIG. 2, Item 102). The frame (See FIG. 2, Item 102) may be shaped to be large enough to hold a barrel 110 of the largest size (such as a twelve-gauge shotgun barrel) and replacement barrels that are smaller in diameter. The barrel 110 can either be removable from the chamber 200 or fixedly connected thereto.

Figure 4:
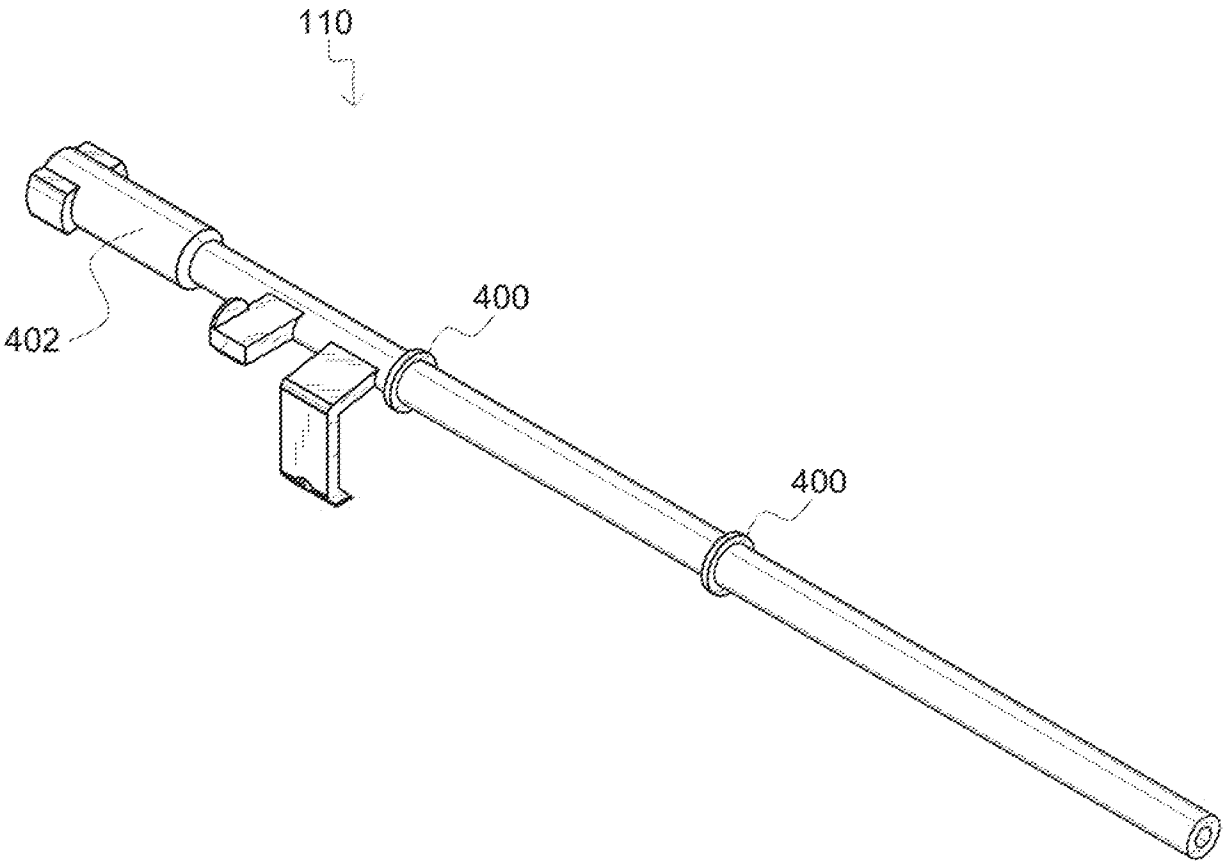
FIG. 4 is a front perspective dew of a barrel of a multi-caliber weapon system showing barrel rings, according to one embodiment of the invention.

FIG. 4 illustrates a front perspective view of a barrel of a multi-caliber weapon system showing barrel rings, according to one embodiment of the invention. As shown, the barrel 110 includes a plurality of barrel rings 400. The barrel rings 400 are disposed around the barrel 110. The barrel 110 also includes a conical chamber coupling 402 disposed opposite the front portion (See e.g., FIG. 1, Item 104) for coupling the barrel 110 to the chamber (See e.g., FIG. 2, Item 200).

The illustrated barrel 110 includes barrel rings 400. The barrel rings 400 are substantially cylindrical and are disposed about an outer circumference of the barrel 110. Each barrel ring 400 is disposed around a circumference of the barrel 110 and is spaced along a length of the barrel 110. The barrel 110 is shown to include two barrel rings 400; however, the barrel may include any number of barrel rings 400 such as, but not limited to: one, three, or five.

In one embodiment, the barrel rings 400 may disposed on the frame flanges (See e.g., FIG. 2, Item 204). The barrel rings 400 may be shaped and sized to rest on the frame flanges (See e.g., FIG. 2, Item 204). The barrel rings 400 are also shaped and sized to circumscribe the barrel 110. Accordingly, the barrel rings 400 may have any diameter or size for circumscribing the barrel 110 and resting on the frame flanges (See e.g., FIG. 2, Item 204). Likewise, the barrel rings 400 may be any regular polygon or circle sized to circumscribe the barrel 110. The barrel rings 400 may be comprised of a variety of materials such as, but not limited to: plastics, rubber, and metals.

The barrel rings 400 may help support the barrel 110 and keep different diameter barrels 110 in the same frame body (See e.g., FIG. 2, Item 102). The number of barrel rings 400 coupled to the barrel 110 may depend on a length and/or width of a chosen barrel 110. The barrel 110 may have crowning or a recess at one end that may be based on compatible cartridge size. As a result, the frame body (See e.g., FIG. 2, Item 102) may be shaped to be large enough to hold a barrel 110 of the largest size, such as a twelve-gauge shotgun barrel, as well as replacement barrels 110 that are smaller in diameter.

Figure 5:
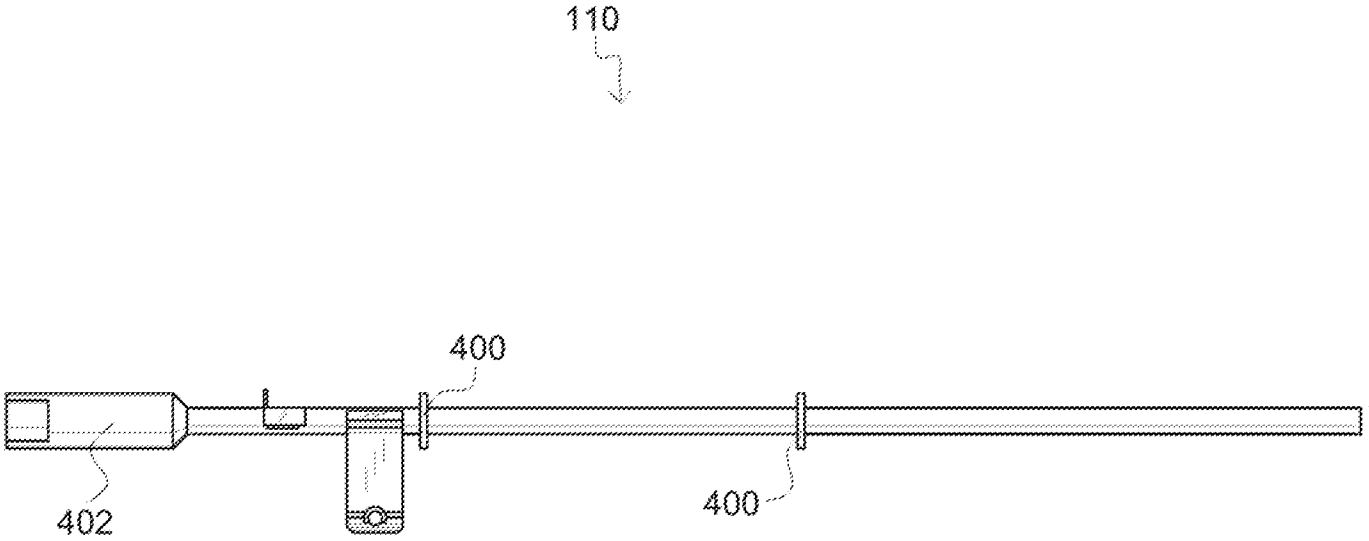
FIG. 5 is a right side elevational view of a barrel of a multi-caliber weapon system showing barrel rings, according to one embodiment of the invention.

FIG. 5 illustrates a right side elevational view of a barrel of a multi-caliber weapon system showing barrel rings, according to one embodiment of the invention. There is shown a plurality of barrel rings 400 disposed about a barrel 110. The barrel 110 also includes a conical chamber coupling 402 coupled to the barrel 110 and extending rearwardly therefrom.

The illustrated barrel 110 includes a conical chamber coupling 402 extending rearward from the barrel 110. The conical chamber coupling 402 couples the barrel 110 to the chamber (See e.g., FIG. 3, Item 200). The conical chamber coupling 402 is conical so that a diameter of the chamber coupling 402 increases as it extends from the barrel to the chamber. However, the conical chamber coupling 402 may have a variety of diameters and lengths. The conical chamber coupling 402 may be cylindrical. The conical chamber coupling 402 may include a variety of couplings for coupling the barrel 110 to the chamber (See e.g., FIG. 3, Item 200) such as, but not limited to: socket couplings, pinning, bolting, threading, locking lugs, tension, and friction. In one non-limiting embodiment, the conical chamber coupling fixedly and/or permanently couples the chamber to the barrel such that the barrel and chamber are a single unit. The conical chamber coupling 402 may be comprised of a variety of materials such as, but not limited to: metals, plastics, and rubber.

Figure 6:
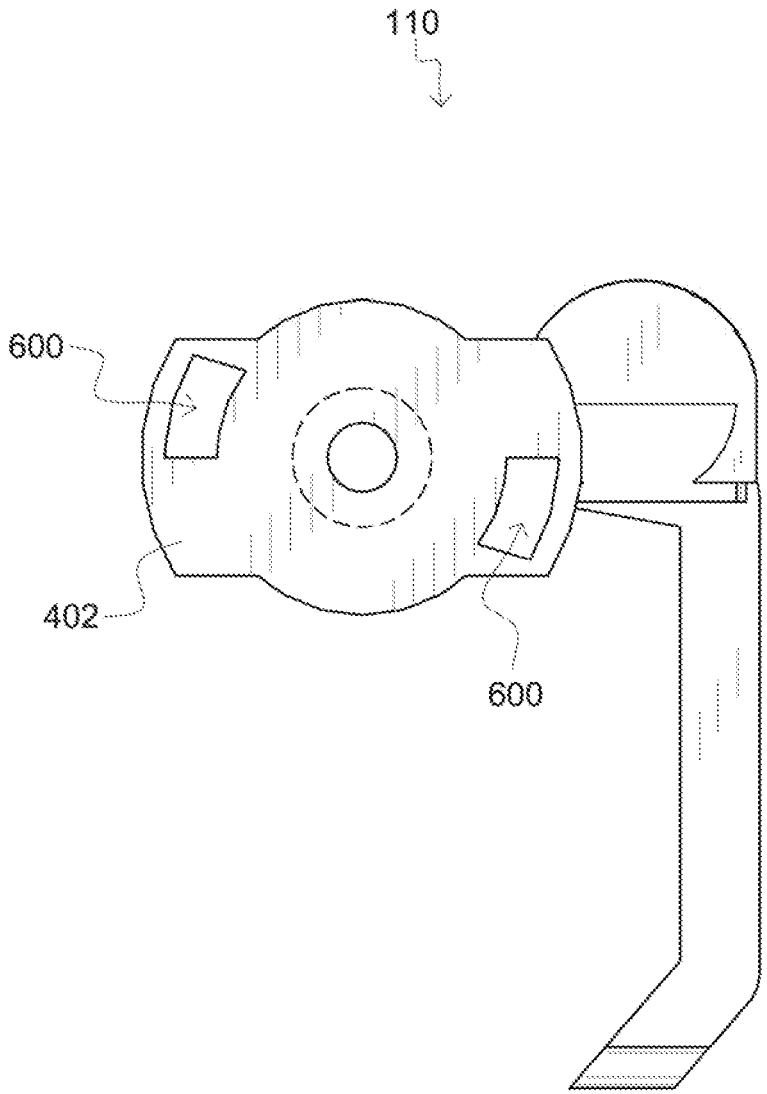
FIG. 6 is a rear elevational view of a barrel of a multi-caliber weapon system, showing barrel voids, according to one embodiment of the invention.

FIG. 6 illustrates a rear elevational view of a barrel of a multi-caliber weapon system, showing barrel voids, according to one embodiment of the invention. As shown, the barrel 110 includes a conical chamber coupling 402. The conical chamber coupling 402 includes barrel voids 600 disposed about the conical chamber coupling 402.

The illustrated conical chamber coupling 402 includes barrel voids 600. The barrel voids 600 are disposed opposite one another along an outside of the conical chamber coupling 402. The barrel voids 600 provide spaces to receive the socket protrusions for removably coupling to the chamber (See e.g., FIG. 3, Item 200). As shown, the conical chamber coupling 402 includes two barrel voids 600. However, the conical chamber coupling 402 may include any number of barrel voids such as, but not limited to, one, four, or six.

Figure 7:
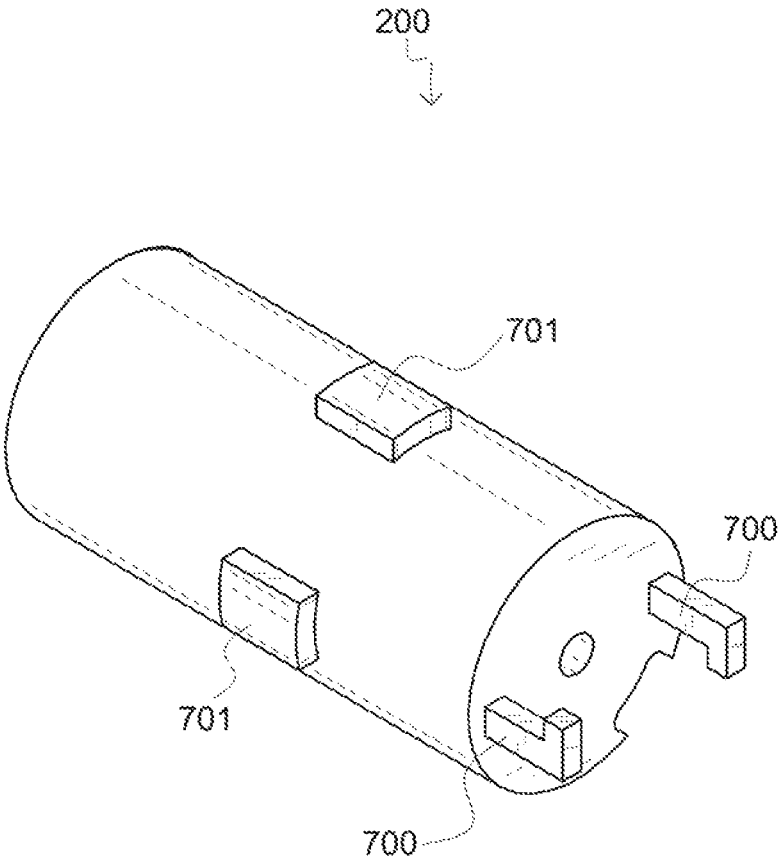
FIG. 7 is a front perspective view of a chamber of a multi-caliber weapon system, according to one embodiment of the invention.

FIG. 7 illustrates a front perspective view of a chamber of a multi-caliber weapon system, according to one embodiment of the invention. There is shown a chamber 200 with socket protrusions 700 extending outwardly therefrom. The socket protrusions 700 removably and slidably couple to the barrel voids (See e.g., FIG. 6, Item 600) so that the chamber 200 removably couples to the barrel (See e.g., FIG. 5, Item 110). The chamber 200 also includes a plurality of teeth 701 disposed along an outside of the chamber 200 and extending outwardly therefrom.

The illustrated teeth 701 are disposed around an outside of the chamber 200 and extend outwardly therefrom. The teeth 701 may be fixedly coupled to the chamber 200 or may be intrinsic to the chamber 200. The teeth 701 may be extensions of the chamber 200. As shown, the chamber 200 includes four teeth 701; however, the chamber 200 may have any number of teeth 701 such as, but not limited to: two, three, or six. The teeth 701 may be comprised of a variety of materials such as, but not limited to: plastics, metals, and rubber. The teeth 701 are substantially rectangular. In one embodiment of the invention, the plurality of teeth 701 may be locking lugs. In another embodiment, the teeth 701 may removably couple the chamber 200 to the chamber holder (See e.g., FIG. 2, Item 201). The teeth 701 may have any size and/or shape for coupling to the chamber holder (See e.g., FIG. 2, Item 201). For instance, in one non-limiting embodiment, the frame body 102 (See e.g., FIG. 2, Item 102) may include a chamber holder (See e.g., FIG. 2, Item 201) with a plurality of notches milled into the chamber holder (See e.g., FIG. 2, Item 201) that couple to the plurality of teeth 701 of the chamber 200, thereby removably coupling the chamber 200 to the chamber holder (See e.g., FIG. 2, Item 201). As a result, the chamber 200 may be twist-locked into place along the frame body (See e.g., FIG. 2, Item 102). Accordingly, the chamber 200 may be locked into the frame body (See e.g., FIG. 2, Item 102) thereby allowing the barrel (See e.g., FIG. 3, Item 110) to be removed from the chamber 200.

The illustrated chamber 200 includes socket protrusions 700. The socket protrusions 700 are substantially L-shaped. In another embodiment, the socket protrusions 700 are substantially foot-shaped. As shown, the illustrated chamber 200 includes two socket protrusions 700. However, the chamber 200 may include any number of socket protrusions 700 such as, but not limited to, one, three, or five. The socket protrusions 700 are coupled to the chamber 200 and extend outwardly therefrom. The socket protrusions 700 may be comprised of a variety of materials such as, but not limited to, metal.

In operation of one embodiment, the barrel (See e.g., FIG. 6, Item 110) may have barrel voids (See e.g., FIG. 6, Item 602) that mate with socket protrusions 700 that slide into the barrel voids (See e.g., FIG. 6, Item 602) and then rotate to the left or to the right. Accordingly, if the barrel (See e.g., FIG. 6, Item 110) is rotated clockwise (when looking from the rear) it will lock the barrel (See e.g., FIG. 6, Item 110) to the chamber 200. When rotated back to the original position, just the barrel (See e.g., FIG. 6, Item 110) will be freed. When rotated to the far counterclockwise, then the chamber 200 and the barrel (See e.g., FIG. 6, Item 110) are freed.

In one non-limiting embodiment, the chamber 200 may be a portion of the barrel (See e.g., FIG. 6, Item 110) in which a round is inserted before being fired. The barrel (See e.g., FIG. 6, Item 110) and chamber 200 may be integral to each other or may be separate from each other. The chamber 200 may be removably coupled to the frame body 102 (See e.g., FIG. 2, Item 102) and/or the barrel (See e.g., FIG. 6, Item 110) through a variety of couplings, such as, but not limited to, locking lugs. Accordingly, the barrel (See e.g., FIG. 6, Item 110) may either be removably coupled to the chamber 200 or may be fixedly connected thereto.

Figure 8:
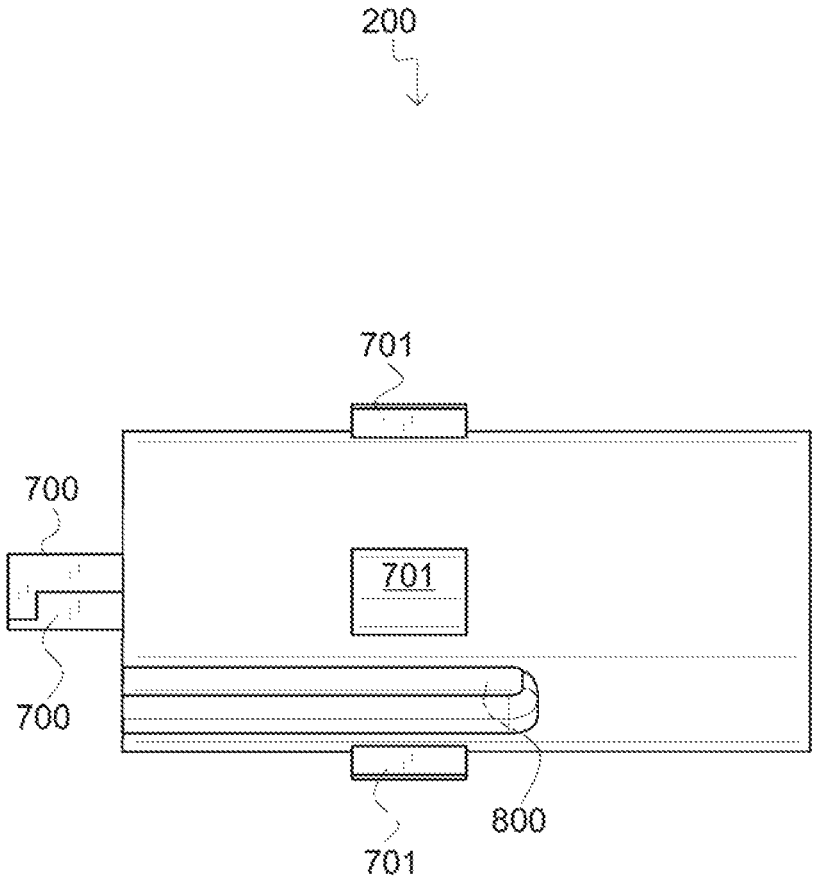
FIG. 8 is a left side elevational view of a chamber of a multi-caliber weapon showing a chamber groove, according to one embodiment of the invention.

FIG. 8 illustrates a left side elevational view of a chamber of a multi-caliber weapon showing a chamber groove, according to one embodiment of the invention. As shown, the chamber 200 includes socket protrusions 700 coupled to the chamber 200 and extending frontwardly therefrom, and a plurality of teeth 701 coupled to the chamber 200 and extending outwardly therefrom. The chamber 200 also includes a chamber groove 800 disposed along an exterior of the chamber 200.

The illustrated chamber 200 includes a chamber groove 800. The chamber groove 800 extends along an outside of the chamber 200. The chamber groove 800 is substantially elongated. However, the chamber groove 800 may have any and size or shape that allows for the chamber to clear the trigger mechanism any other parts in that same area. For instance, the chamber groove may be straight, curved, S-shaped, ridged and so on. The chamber groove may be bored or milled into the chamber 200.

Figure 9:
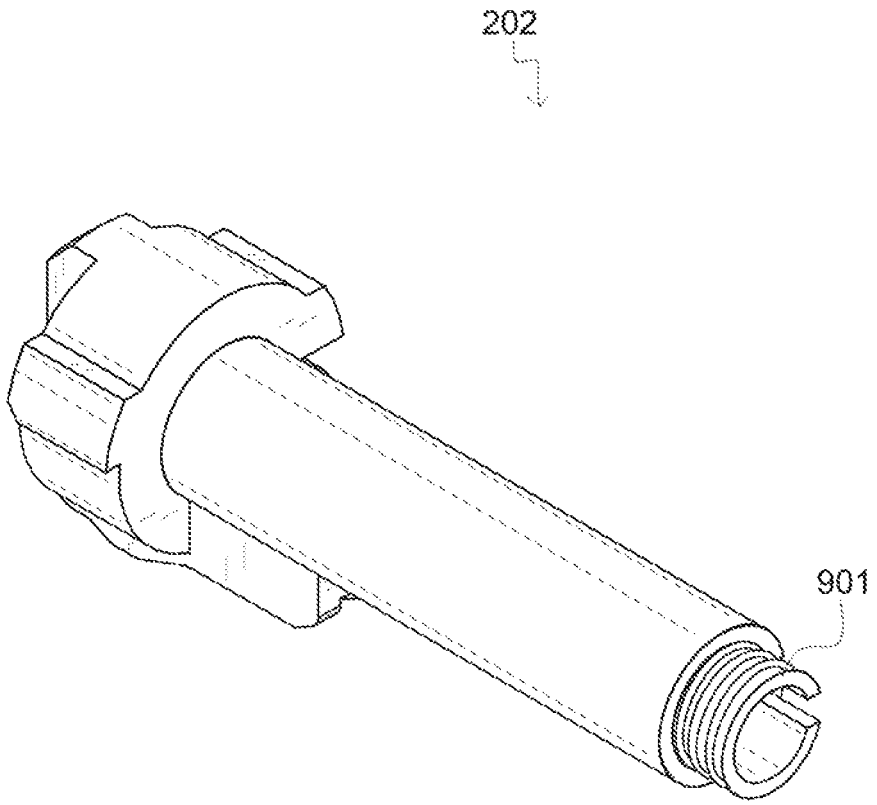
FIG. 9 is a front perspective view of a bolt of a multi-caliber weapon system, according to one embodiment of the invention.

FIG. 9 illustrates a front perspective view of a bolt of a multi-caliber weapon system, according to one embodiment of the invention. There is shown a bolt 202. The bolt 202 removably couples to the chamber and/or chamber holder (See e.g., FIG. 8, Item 200). Disposed on one end of the illustrated bolt 202 is a front bolt portion 901. The front bolt portion 901 may be a threaded hollow tube. In one, non-limiting embodiment the bolt 202 may include threading.

The illustrated bolt 202 is elongated and slidably and removably coupled to the chamber and/or chamber holder (See e.g., FIG. 8, Items 200 and 201, respectively). The bolt 202 may slide along an interior of frame body (See e.g., FIG. 2, Item 106) and along an exterior of the chamber (See e.g., FIG. 8, Item 200). The bolt 202 may be comprised of a variety of materials such as, but not limited to, metal.

In operation of one embodiment, the bolt 202 blocks a rear opening of the chamber (See e.g., FIG. 8, Item 200) while a propellant burns and moves forward and backward to facilitate loading and unloading of cartridges. In manually operated firearms, the bolt 202 is held fixed to the frame body by locking lugs during firing and is manually withdrawn to chamber another round. In semi-automatic or automatic firearms, the bolt 202 cycles back and forward between each shot. The bolt 202 may include a bolt face and any rotational element that allows the bolt 202 to lock into rear of the chamber and/or chamber holder (See e.g., FIG. 2, Items 200 and 201).

Figure 10:
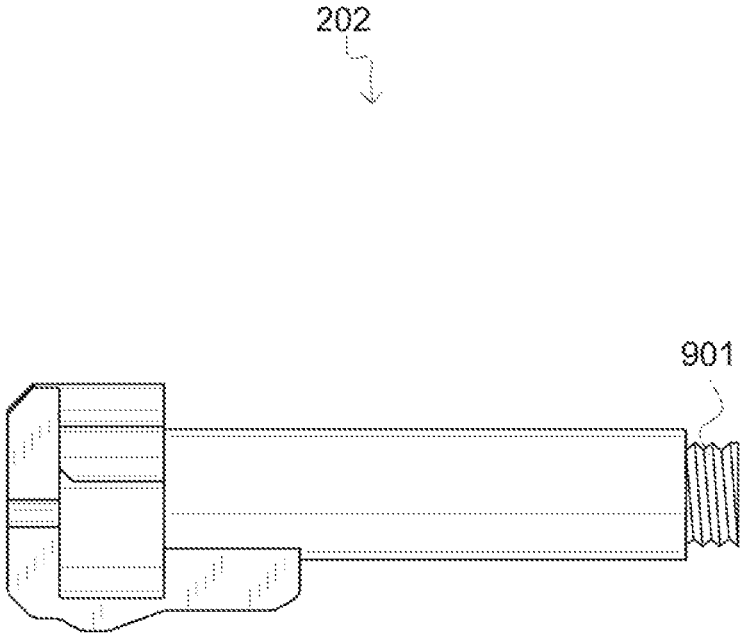
FIG. 10 is a right side devotional view of a bolt of a multi-caliber weapon system according to one embodiment of the invention.

FIG. 10 illustrates a right side elevational view of a bolt of a multi-caliber weapon system according to one embodiment of the invention. As shown, there is a bolt 202. The bolt 202 slidably and functionally couples to the chamber and/or chamber holder (See e.g., FIG. 8, Items 200 and 201, respectively). The bolt 202 includes a front bolt portion 901 coupled to an end of the bolt 202 and extending frontwardly therefrom.

The illustrated bolt 202 includes a front bolt portion 901. The front bolt portion 901 removably couples to the bolt face (See e.g., FIG. 3, Item 300). The front bolt portion 901 may removably couple to the bolt face (See e.g., FIG. 3, Item 300) through a variety of couplings such as, but not limited to: threading, pinning, bolting, locking lugs, tension and friction. In one non-limiting embodiment, the front bolt portion may include threading. Accordingly, the front bolt portion 901 may removably coupled to a variety of bolt faces (See e.g., FIG. 3, Item 300) such as those of different sizes, for example.

Figure 11:
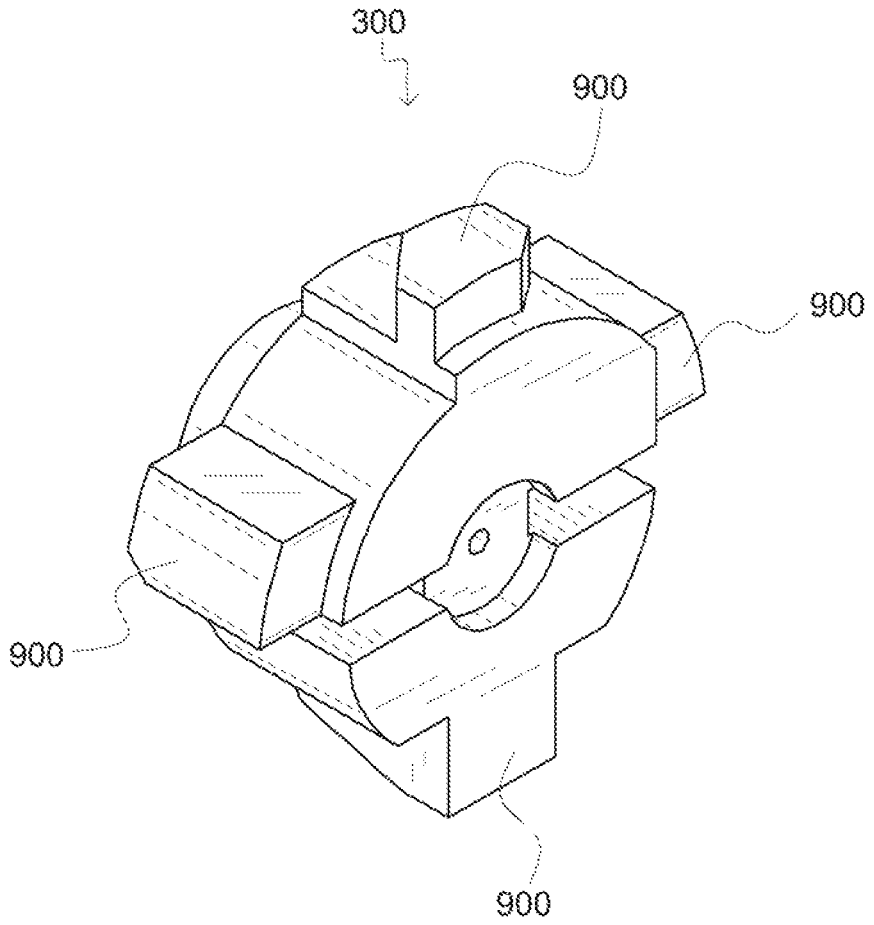
FIG. 11 is a front perspective view of a bolt face of a multi-caliber weapon system showing an array of bolt face tabs, according to one embodiment of the invention.

FIG. 11 illustrates a front perspective view of a bolt face of a multi-caliber weapon system showing an array of bolt face tabs, according to one embodiment of the invention. There is shown a bolt face 300. An array of bolt face tabs 900 are disposed about the bolt face 300. The bolt face 300 is removably coupled to the bolt (See e.g., FIG. 10, Item 202) and removably and functionally coupled to the chamber and/or chamber holder (See e.g., FIG. 2, Items 200 and 201).

In one embodiment of the invention, the bolt face 300 is the surface of the bolt (See e.g., FIG. 10, Item 202) that makes contact with the base of a cartridge case. The bolt face 300 keeps a round in place when the round is chambered. The bolt face 300 may be removably coupled to the bolt (See e.g., FIG. 10, Item 202) so that a particular bolt face 300 may be used to coincide with particular cartridges and or shells. The bolt face 300 may have a variety of shapes and/or sizes for coupling to the bolt (See e.g., FIG. 10, Item 202) and contacting a cartridge. In one embodiment of the invention, the bolt face 300 may be a standard sized boll face 300 that has been milled out to fit dimensions of a desired head stamp.

The illustrated bolt face 300 includes an array of bolt face tabs 900 disposed about an outside of the bolt face 300 extending outwardly therefrom. As shown, the bolt face 300 includes four bolt face tabs 900. However, the bolt face 300 may include any number of bolt face tabs 900 such as, but not limited to, one, three, or six. The bolt face tabs 900 may be comprised of a variety of materials such as, but not limited to metal.

Figure 12:
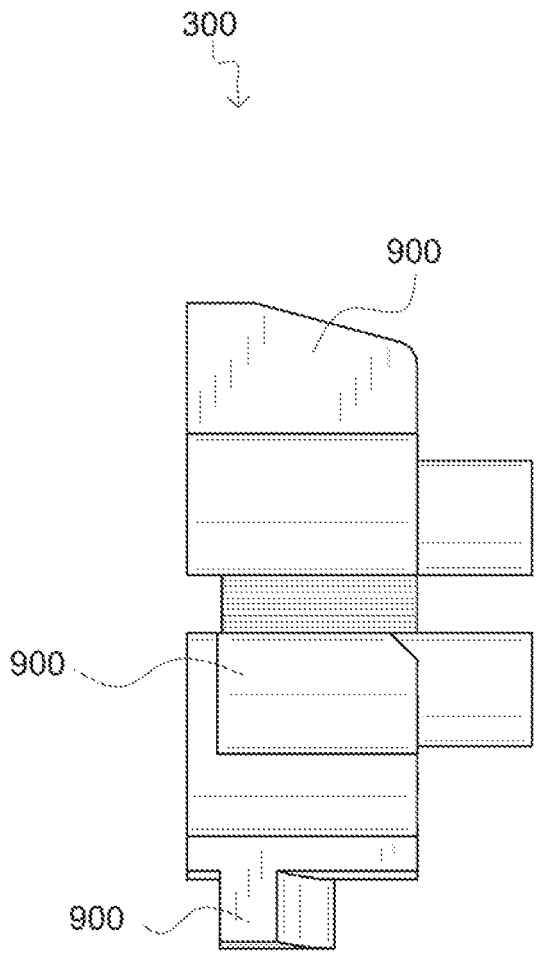
FIG. 12 is a left side elevational view of a bolt face of a multi-caliber weapon system, according to one embodiment of the invention.

FIG. 12 illustrates a left side elevational view of a bolt face of a multi-caliber weapon system, according to one embodiment of the invention. As shown, there is a bolt face 300. The bolt face 300 includes an array of bolt face tabs 900 coupled to the bolt face 300 and extending outwardly therefrom. The bolt face 300 removably couples to the bolt (See e.g., FIG. 10, Item 202) and removably and functionally couples to the chamber (See e.g., FIG. 8, Item 200).

The illustrated bolt face 300 removably couples o the bolt (See e.g., FIG. 10, Item 202). The bolt face 300 may removably couple to the bolt through a variety of couplings, such as, but not limited to: threading, pinning, bolting, locking lugs, tension and friction. The bolt face 300 may also removably and functionally couple to the chamber (See e.g., FIG. 8, Item 200). In one embodiment of the invention, the bolt face 300 may be threadably coupled to the bolt (See e.g., FIG. 10, Item 202), thereby allowing for removal of the bolt face 300 from the bolt (See e.g., FIG. 10, Item 202) by unscrewing. The bolt face 300 may be disposed adjacent to the chamber (See e.g., FIG. 8, Item 200).

In one embodiment of the invention, each bolt face tab 900 may have a same outer diameter, but may have a different inner diameter for functionally coupling to a head stamp of a cartridge in the chamber (See e.g., FIG. 8, Item 200). For example, a bottom bolt face tab 900 may function to strip a round from a magazine and guide it into the chamber (See e.g., FIG. 8, Item 200). Other tabs 900 may enable the bolt (See e.g., FIG. 10, Item 202) to rotate and to slide into the chamber and/or chamber holder. Advantageously, the tabs 900 may create a slight delay to drop the chamber pressure to a safe level, and to prevent two bullets from being in the barrel at the same time.

Figure 13:
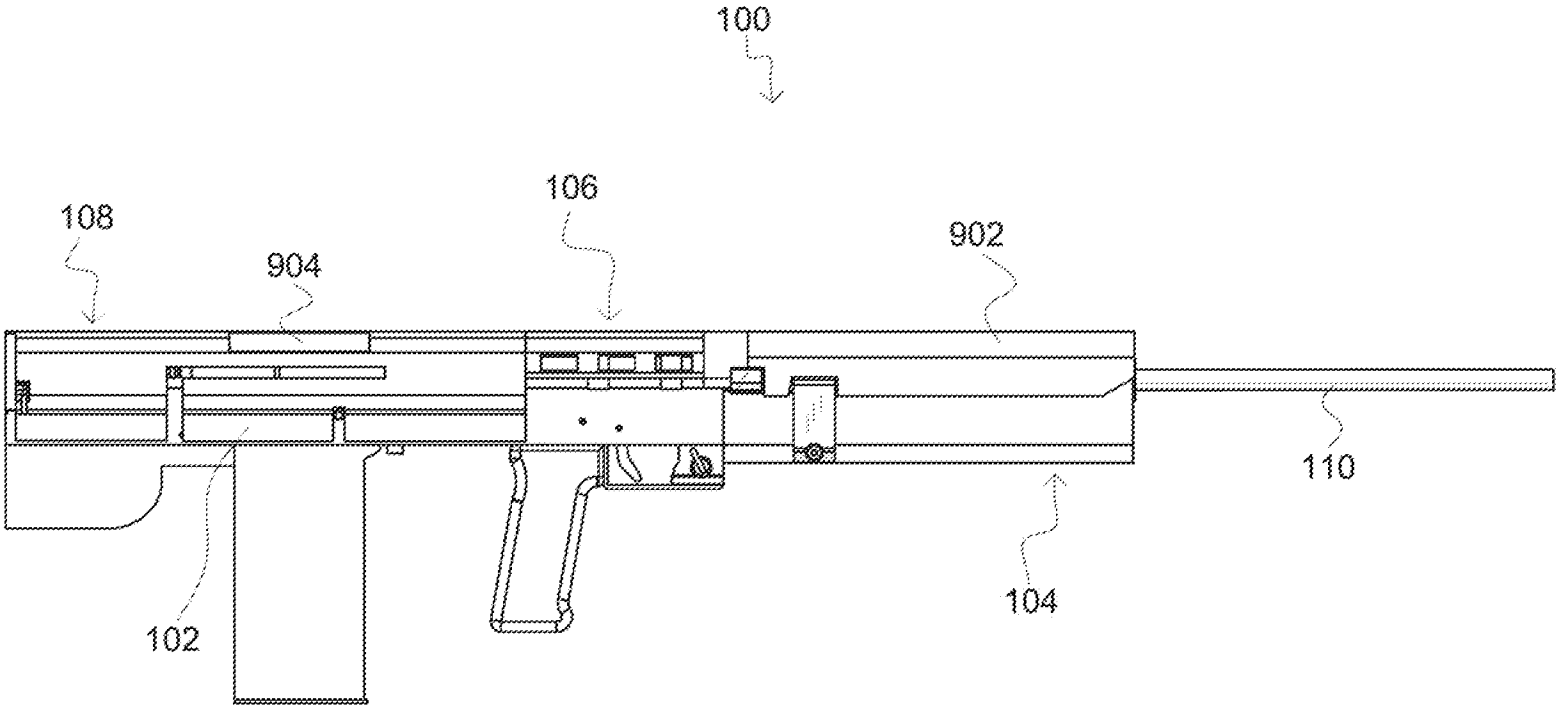
FIG. 13 is a right side devotional view of a multi-caliber weapon system showing a front frame cover and a rear frame cover, according to one embodiment of the invention.

FIG. 13 illustrates a right side elevational view of a multi-caliber weapon system showing a front frame cover and a rear frame cover, according to one embodiment of the invention. There is shown a multi-caliber weapon system 100 with a frame body 102. The frame body 102 has a front body portion 104, a middle body portion 106, and a rear body portion 108. A barrel 110 is coupled to the front body portion 104 and extends outwardly therefrom. A front frame cover 902 is disposed over a portion of the barrel 110 and is disposed over the middle body portion 106 and the front body portion 104 of the frame body 102. A rear frame cover 904 is disposed over the middle body portion 106 and the rear body portion 108 of the frame body 102.

The illustrated front frame cover 902 is coupled to the frame body 102 along the front body portion 104 and the middle body portion 106. The front frame cover 902 may be coupled to the frame body 102 through a variety of coupling methods such as, but not limited to: tension, friction, adhesion, pinning, bolting, locking lugs, and tongue and groove. In one non-limiting embodiment, the front frame cover 902 may be hingedly coupled to the middle body portion 106 of the frame body 102. The front frame cover 902 is substantially elongated and covers a portion of the barrel 110. The front frame cover 902 may be comprised of a variety of materials such as, but not limited to: metals, plastics, and rubber.

The illustrated rear frame cover 904 is coupled to the frame body 102 along the middle body portion 106 and the rear body portion 108. The rear frame cover 904 may also be removably coupled to the front frame cover 902. The rear frame cover 904 may be coupled to the frame body 102, the mid-section 106, and/or the front frame cover 902 through a variety of coupling methods such as, but not limited to: tension, friction, adhesion, pinning, bolting, locking lugs, and tongue and groove. In one non-limiting embodiment, the rear frame cover 904 may be hingedly coupled to the middle body portion 106 of the frame body 102. The rear frame cover 904 is substantially elongated and covers the rear body portion 108. The rear frame cover 904 may be comprised of a variety of materials such as, but not limited to: metals, plastics, and rubber. The frame covers 902 and 904 allow one to easily get to the barrel, chamber and bolt face to remove or replace them (See e.g., FIG. 3, Items 110, 200 and 300).

Figure 14:
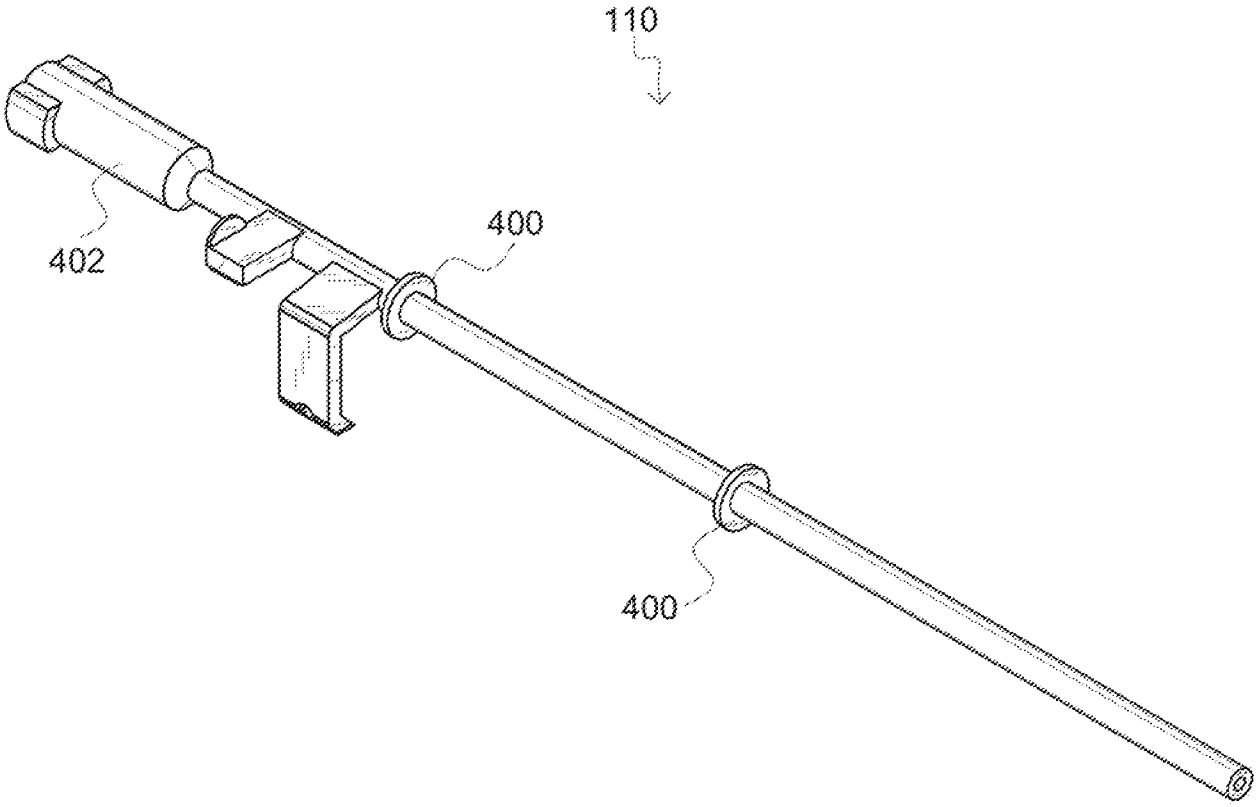
FIG. 14 is a right side devotional view of a barrel of a multi-caliber weapon system, according to one embodiment of the invention.

FIG. 14 illustrates a right side elevational view of a barrel of a multi-caliber weapon system, according to one embodiment of the invention. As shown, a plurality of barrel rings 400 is disposed about a barrel 110. The barrel 110 also includes a conical chamber coupling 402 coupled to the barrel 110 and extending rearwardly therefrom.

In one embodiment of the invention, the barrel 110 may be a barrel of the largest size (i.e. twelve-gauge shotgun barrel). The barrel 110 may be smaller in diameter than a twelve-gauge shotgun barrel 110. The barrel 110 includes one or more barrel rings that seat into flanges in the frame (See e.g., FIG. 2, Items 204 and 102, respectively). The barrel rings 400 may have the same diameter as a twelve-gauge shotgun barrel. In such an example, any barrel smaller than a barrel for a twelve gauge shotgun would include barrel rings, a barrel for a twelve-gauge shotgun would not include barrel rings, and any barrel larger than that of a twelve gauge shotgun would either include inset grooves instead of barrel rings or would not be included in the weapon system.

The illustrated barrel 110 includes a conical chamber coupling 402 extending rearward from the barrel 110. The conical chamber coupling 402 couples the barrel 110 to the chamber (See e.g., FIG. 3, Item 200). The conical chamber coupling 402 is conical so that a diameter of the chamber coupling 402 increases as it extends from the barrel to the chamber. However, the conical chamber coupling 402 may have a variety of diameters and lengths. The conical chamber coupling 402 may be cylindrical. The conical chamber coupling 402 may include a variety of couplings for coupling the barrel 110 to the chamber (See e.g., FIG. 3, Item 200) such as, but not limited to: socket couplings, pinning, bolting, threading, tension, and friction. The conical chamber coupling 402 may be comprised of a variety of materials such as, but not limited to: metals, plastics, and rubber. As a result, the mufti-caliber weapon system (See e.g., FIG. 1, Item 100) may include a plurality of barrels 110 that may each be selectably and removably coupleable to the frame body (See e.g., FIG. 1, Item 102) and/or to the chamber (See e.g., FIG. 3, Item 200).

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a separate bolt and bolt face, the bolt and bolt face may be one piece. More, the rear end of the bolt may be threaded so that the bolt and bolt face may be removed together.

It is also envisioned that the bolt and bolt face may each include markings that one lines up evenly with the bolt and bolt face, respectively, to verify that the bolt face is aligned correctly with respect to the bolt. Likewise, a slot may be milled into the bolt face and along the length of the bolt. The slot may enable an ejector tab to contact a head stamp. As a result, the multi-caliber weapon system may include a variety of bolt and/or bolt face sets to couple to the bolt-carrier of the weapon for use with multiple caliber, cartridges, and shells.

It is expected that there could be numerous variations of the design of this invention. An example is that there may be many different combinations of barrels, chambers, bolts, and bolt faces coupled to the frame body to allow for lots of variation in cartridges and shells used with the multi-caliber weapon system.

Further, while a rifle is illustrated, it is understood that there may be non-rifle embodiments of the present invention, such as but not limited to pistols/revolvers, musket loaders, and the like.

Finally, it is envisioned that the components of the device may be constructed of a variety of materials, such as, but not limited to: plastics, metals, wood, glass, leather and rubber.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A multi-caliber weapon system, comprising:

a. a frame body, with a front body portion, a middle body portion, and a rear body portion, and including:

i. a plurality of frame flanges, each frame flange being coupled to an interior of the frame body and extending upwardly therefrom;

b. a barrel, removably coupled to the front body portion of the frame body, including:

i. a plurality of cylindrical barrel rings, each barrel ring being disposed around a circumference of the barrel and spaced along a length of the barrel, wherein the cylindrical barrel rings are disposed on the frame flanges;

c. a chamber, removably coupled to the middle body portion of the frame body, and removably coupled to the barrel; and d. a bolt, removably coupled to the rear body portion of the frame body, removably coupled to the chamber, and including:

i. a bolt face, removably coupled to a front bolt portion.

2. The multi-caliber weapon system of claim 1, wherein the frame body further comprises a chamber holder disposed along a middle body portion, wherein the chamber is disposed within the chamber holder and is removably and slidably coupled to the chamber holder.

3. The multi-caliber weapon system of claim 1, further comprising a frame body cover, removably coupled to the frame body, and disposed over a portion of the barrel, the chamber, and the bolt.

4. The multi-caliber weapon system of claim 1, wherein the bolt face includes an array of bolt face tabs disposed about an outside of the bolt face.

5. The multi-caliber weapon system of claim 1, wherein the chamber further comprises a chamber groove disposed along an outside of the chamber.

6. The multi-caliber weapon system of claim 1, further comprising:

a. a front frame cover removably coupled to the front body portion of the frame body; and b. a rear frame cover disposed adjacent to the front frame cover and removably coupled to the rear body portion of the frame body.

7. The multi-caliber weapon system of claim 1, wherein the barrel includes a conical chamber coupling disposed at an end opposite a front of the barrel and near the middle portion.

8. The multi-caliber weapon system of claim 1, further comprising a plurality of barrels, wherein each barrel is selectably and removably coupleable to the chamber.

9. The multi-caliber weapon system of claim 1, wherein the chamber includes socket protrusions, and the barrel includes barrel voids removably coupled to the socket protrusions.

10. The multi-caliber weapon system of claim 2, wherein the chamber includes a plurality of teeth disposed along an outside of the chamber and extending outwardly therefrom, and wherein the plurality of teeth are removably and slidably coupled to the chamber holder.

11. A multi-caliber weapon system, comprising:

a. a frame body, with a front body portion, a middle body portion, and a rear body portion, and including:

i. a plurality of frame flanges, each frame flange being coupled to an interior of the frame body and extending upwardly therefrom;

b. a barrel, removably coupled to the front body portion of the frame body, including:

i. a plurality of barrel rings, each barrel ring being disposed around a circumference of the barrel and spaced along a length of the barrel, wherein the barrel rings are disposed on the frame flanges;

c. a chamber, removably coupled to the middle body portion of the frame body, and removably coupled to the barrel;

d. a bolt, removably coupled to the rear body portion of the frame body, removably coupled to the chamber, and including:

i. a bolt face, removably coupled to a front bolt portion; and e. wherein the barrel includes a conical chamber coupling disposed at an end opposite the front body portion and near the middle body portion, and removably coupled to the chamber.

12. The multi-caliber weapon system of claim 11, wherein the bolt face includes an array of bolt face tabs disposed about an outside of the bolt face.

13. The multi-caliber weapon system of claim 12, wherein the chamber further comprises a chamber groove disposed along an outside of the chamber.

14. The multi-caliber weapon system of claim 13, wherein the frame body further comprises a chamber holder disposed along a middle body portion, wherein the chamber is disposed within the chamber holder and is removably and slidably coupled to the chamber holder.

15. The multi-caliber weapon system of claim 14, wherein the chamber includes a plurality of teeth disposed along an outside of the chamber and extending outwardly therefrom, wherein the plurality of teeth are removably and slidably coupled to the chamber holder.

16. The multi-caliber weapon system of claim 15, further comprising a plurality of barrels, wherein each barrel is selectably and removably coupleable to the chamber.

17. The multi-caliber weapon system of claim 16, further comprising a frame body cover, removably coupled to the frame body, and disposed over a portion of the barrel, the chamber, and the bolt.

18. The multi-caliber weapon system of claim 17, further comprising:

a. a front frame cover removably coupled to the front body portion of the frame body; and b. a rear frame cover disposed adjacent to the front frame cover and removably coupled to the rear body portion of the frame body.

19. The multi-caliber weapon system of claim 18, wherein the chamber includes socket protrusions, and the barrel includes barrel voids removably coupled to the socket protrusions.

20. A multi-caliber weapon system, comprising:

a frame body, with a front body portion, a middle body portion, and a rear body portion, and including:

i. a plurality of concave frame flanges, each frame flange being coupled to an interior of the frame body and extending upwardly therefrom; and ii. a chamber holder disposed along a middle body portion;

b. a barrel, removably coupled to the front body portion of the frame body, including:

i. a plurality of barrel rings, each barrel ring being disposed around a circumference of the barrel and spaced along a length of the barrel, wherein the barrel rings are disposed on the frame flanges; and ii. a conical chamber coupling disposed at an end opposite the front body portion and near the middle body portion, and having barrel voids;

c. a chamber, removably coupled to the middle body portion of the frame body, removably coupled to the conical chamber coupling of the barrel, including a chamber groove disposed along an outside of the chamber, and including socket protrusions coupled to the chamber and extending outwardly therefrom, removably coupleable to the barrel voids of the chamber coupling, wherein the chamber includes a plurality of teeth disposed along an outside of the chamber and extending outwardly therefrom, the plurality of teeth being removably and slidably coupleable to the chamber holder;

d. a bolt, removably coupled to the rear body portion of the frame body, removably coupled to the chamber, and including:

i. a bolt face, removably coupled to a front bolt portion, wherein the bolt face includes an array of bolt face tabs disposed about an outside of the bolt face; and e. a frame body cover, removably coupled to the frame body, and disposed over a portion of the barrel, the chamber, and the bolt, wherein the frame body cover includes:

i. a front frame cover removably coupled to the front body portion of the frame body; and ii. a rear frame cover disposed adjacent to the front frame cover and removably coupled to the rear body portion of the frame body.

* * * * *